US007850434B2

(12) United States Patent
Stones

(10) Patent No.: US 7,850,434 B2
(45) Date of Patent: Dec. 14, 2010

(54) PUMPING ARRANGEMENT

(75) Inventor: Ian David Stones, Burgess Hill (GB)

(73) Assignee: Edwards Limited, Crawley, West Sussex (GB)

( * ) Notice: Subject to any disclaimer, the term of this patent is extended or adjusted under 35 U.S.C. 154(b) by 1038 days.

(21) Appl. No.: 11/596,915

(22) PCT Filed: May 6, 2005

(86) PCT No.: PCT/GB2005/001701

§ 371 (c)(1),
(2), (4) Date: Nov. 17, 2006

(87) PCT Pub. No.: WO2005/113986

PCT Pub. Date: Dec. 1, 2005

(65) Prior Publication Data

US 2008/0063541 A1 Mar. 13, 2008

(30) Foreign Application Priority Data

May 21, 2004 (GB) ..... 0411426.0

(51) Int. Cl.
*F04D 19/04* (2006.01)

(52) U.S. Cl. ..... 417/250; 417/251; 417/423.4

(58) Field of Classification Search ..... 417/423.4, 417/248, 250, 251; 415/60–62, 66–68
See application file for complete search history.

(56) References Cited

U.S. PATENT DOCUMENTS 3,616,680 A 11/1971 Schrader
4,919,599 A 4/1990 Reich et al.
5,733,104 A * 3/1998 Conrad et al. ..... 417/44.1
2001/0048074 A1 12/2001 Shiokawa et al.
2004/0146410 A1 * 7/2004 Conrad et al. ..... 417/245

FOREIGN PATENT DOCUMENTS

EP 1 077 329 A1 2/2001

(Continued)

OTHER PUBLICATIONS

Nakagawa Yoshitomo; abstract of JP2003016990 A, "Inductively Coupled Plasma Mass Spectrometer," Jan. 17, 2003; Seiko Instr Inc.

(Continued)

*Primary Examiner*—Devon C Kramer
*Assistant Examiner*—Philip Stimpert

(57) ABSTRACT

A differentially pumped system comprises a plurality of pressure chambers; and a pumping arrangement (100) attached thereto for evacuating the chambers, the pumping arrangement comprising first and second compound pumps (102, 104) each comprising at least a first inlet (120); (124), a second inlet (122); (126), a first pumping section (110) and a second pumping section (112) downstream from the first pumping section, the sections being arranged such that fluid entering the pump from the first inlet passes through the first and second pumping sections and fluid entering the pump from the second inlet passes through, of said sections, only the second section, wherein the first inlet (120) of the first pump (102) is attached to an outlet from a first, relatively low, pressure chamber (10), the second inlet (122) of the first pump (102) and the first inlet (124) of the second pump (104) are attached to an outlet or respective outlets from a second, common medium pressure chamber (16), and the second inlet (126) of the second pump (104) is attached to an outlet from a third, relatively high pressure chamber (14).

20 Claims, 4 Drawing Sheets

FOREIGN PATENT DOCUMENTS

| | | | |
|---|---|---|---|
| EP | 1 085 214 | B1 | 3/2001 |
| GB | 2 309 580 | A | 7/1997 |
| JP | 11-162399 | | 6/1999 |
| JP | 11-185695 | | 7/1999 |
| JP | 2003-16990 | | 1/2003 |
| WO | WO 00/53928 | | 9/2000 |
| WO | WO 02/05310 | A1 | 1/2002 |

OTHER PUBLICATIONS

Kitamoto Atsushi; abstract of JP11185695 A, "Inductive Coupling Plasma Mass Spectrograph," Jul. 9, 1999; Yokogawa Analytical Systems Inc.

Kitamoto Atsushi; abstract of JP11162399 A; "Inductively Coupled Plasma Mass Spectrograph with Common Pump," Jun. 18, 1999; Yokokawa Analytical Systems Inc.

United Kingdom Search Report of Application No. GB0411426.0 dated Oct. 13, 2004; Claims searched: 1-29, 31 and 32; Date of search: Oct. 12, 2004.

PCT Notification of Transmittal of the International Search Report and the Written Opinion of the International Searching Authority, or the Declaration of International Application No. PCT/GB2005/001701; Date of Mailing Sep. 14, 2005.

PCT International Search Report of International Application No. PCT/GB2005/001701; Date of Mailing of the International Search Report: Sep. 14, 2005.

PCT Written Opinion of the International Searching Authority of International Application No. PCT/GB2005/001701; Date of mailing: Sep. 14, 2005.

* cited by examiner

PUMPING ARRANGEMENT

FIELD OF THE INVENTION

This invention relates to a pumping arrangement and in particular to a pumping arrangement for differential pumping of multiple chambers.

BACKGROUND OF THE INVENTION

In a differentially pumped mass spectrometer system a sample and carrier gas are introduced to a mass analyser for analysis. One such example is given in FIG. 1, in which there exists a high vacuum chamber 10 immediately following a number of evacuated interface chambers, the actual number of such chambers depending on the type of system. In the example shown in FIG. 1, the system includes first, second and third evacuated interface chambers 12, 14 and 16.

The first interface chamber 12 is the highest-pressure chamber in the evacuated spectrometer system and may contain a gas inlet means through which ions are drawn from the ion source into the first interface chamber 12. The ion source may be at atmospheric pressure depending upon the ionisation method employed. The second interface chamber 14 and subsequent lower pressure chambers may contain ion optics and means of analysis known to those skilled in the art.

In this example, in use, the first interface chamber 12 is at a pressure of around 1-10 mbar, the second interface chamber 14 is at a pressure of around $10^{-3}$-$10^{-2}$ mbar, the third interface chamber 16 is at a pressure of around $10^{-5}$-$10^{-4}$ mbar, and the high vacuum chamber 10 is at a pressure of around $10^{-7}$-$10^{-6}$ mbar.

To evacuate the chambers, in this example the low pressure chamber 10 is evacuated by a turbomolecular pump 20 exhausting to a backing pump 22 or another appropriate point on the vacuum system, the second and third interface chambers 14, 16 are evacuated by a compound vacuum pump 24 exhausting to the backing pump 22, and the first interface chamber 12 is evacuated by the backing pump 22. The backing pump 22 may be a relatively large, floor standing, rotary vane pump or other appropriate type of vacuum pump.

In this example, the compound vacuum pump 24 has two pumping sections in the form of two sets 30, 32 of turbomolecular stages, and a third pumping section in the form of a Holweck drag mechanism 34; an alternative form of drag mechanism, such as a Siegbahn or Gaede mechanism, could be used instead. Each set 30, 32 of turbomolecular stages comprises a number (four shown in FIG. 1, although any suitable number could be provided) of rotor and stator blade pairs of known angled construction. The Holweck mechanism 34 includes a number (two shown in FIG. 1, although any suitable number could be provided) of rotating cylinders, corresponding annular stators, and helical channels in a manner known per se.

A first compound pump inlet 36 is connected to the third interface chamber 16, and fluid pumped through the inlet 36 passes through both sets 30, 32 of turbo-molecular stages in sequence and the Holweck mechanism 34 and exits the pump via outlet 38. A second compound pump inlet 40 is connected to the second interface chamber 14, and fluid pumped through this inlet 40 passes through set 32 of turbo-molecular stages and the Holweck mechanism 34 and exits the pump via outlet 38. The compound pump 24 may include additional inlets, for example interstage the turbomolecular and Holweck pumping stages, if required to pump additional system chambers.

As fluid entering each compound pump inlet passes through a respective different number of stages before exiting from the compound pump, the compound pump 24 is able to provide the required vacuum levels in the chambers 14 and 16, with the backing pump 22 providing the required vacuum level in the chamber 12 and the turbomolecular pump 20 providing the required vacuum level in the chamber 10.

Utilising a compound pump to evacuate two or more adjacent chambers offers advantages in size, cost, and component rationalisation. However, in view of the conductance limitations of typical compound pumping arrangements performance is compromised in comparison to an arrangement where each of the intermediate chambers is evacuated using a bespoke vacuum pump directly mounted on to the respective intermediate chamber.

Depending on the type of mass spectrometer system, pumping performance can also be significantly affected when, as shown in FIG. 1, an additional gas load is introduced into one of the intermediate chambers 14 or 16 through, for example, a collision cell, gas reaction cell or ion trap. In the example shown in FIG. 1 the additional gas load is depicted as being introduced into chamber 16. To maintain pressures in this chamber a much higher level of pumping performance is now required at the chamber.

An aim of this invention is to provide a pumping arrangement for a plurality of chambers which offers the required level of performance without substantially increasing the size, cost or number of pumps in the pumping arrangement.

SUMMARY OF THE INVENTION

In a first aspect, the present invention provides a differentially pumped vacuum system comprising apparatus, for example a mass spectrometer, having a plurality of pressure chambers; and a pumping arrangement attached thereto for evacuating the chambers, the pumping arrangement comprising first and second compound pumps each comprising at least a first inlet, a second inlet, a first pumping section and a second pumping section downstream from the first pumping section, the sections being arranged such that fluid entering the pump from the first inlet passes through the first and second pumping sections and fluid entering the pump from the second inlet passes through, of said sections, only the second section, wherein the second inlet of one of the pumps and the first inlet of the other pump are attached to an outlet or respective outlets from a common pressure chamber so that, in use, the first compound pump evacuates said one of the pressure chambers in parallel with the second compound pump.

In the preferred embodiments, the first inlet of the first pump is attached to an outlet from a first, relatively low, pressure chamber, and the second inlet of the first pump and the first inlet of the second pump are attached to an outlet or respective outlets from a higher pressure chamber. For example, the second inlet of the first pump and the first inlet of the second pump are attached to an outlet or respective outlets from a second, medium pressure chamber, and the second inlet of the second pump is attached to an outlet from a third, relatively high pressure chamber.

Preferably, at least one, more preferably both, of the first and second pumping sections comprises at least one turbomolecular stage. These may be of the same size, or of different sizes. For example, the stage(s) of the second pumping section may be larger than the stages of the first pumping section to offer selective pumping performance.

The second compound pump preferably comprises a third pumping section downstream from the second pumping section, the sections being arranged such that fluid entering the pump from the first inlet passes through the first, second and third pumping sections, and fluid entering the pump from the second inlet passes through, of said sections, only the second and third pumping sections. This third pumping section preferably comprises a multi-stage molecular drag mechanism, for example, a multi-stage Holweck mechanism with a plurality of channels arranged as a plurality of helixes.

At least the second compound pump preferably comprises a third inlet for receiving fluid from a fourth pressure chamber, the pumping sections being arranged such that fluid entering the pump from the fourth chamber passes through, of said sections, only the third pumping section. The third pumping section may be arranged such that fluid passing therethrough from the third inlet may follow a different path than fluid passing therethrough from the second inlet. For example, the third pumping section may be arranged such that fluid passing therethrough from the third inlet follows only part of the path of the fluid passing therethrough from the second inlet. Each compound pump preferably has a said third inlet arranged to receive fluid from the fourth pressure chamber, the compound pumps being arranged such that the first compound pump evacuates the fourth pressure chamber in parallel with the second compound pump. In preferred embodiments, each said third inlet is connected to conduit means for conveying fluid thereto from an outlet of the fourth pressure chamber.

The second compound pump may include additional inlets if required to pump additional system chambers, for example interstage the turbomolecular and Holweck pumping stages. The fluid entering the pump through any additional ports may pass through only a portion of the pumping sections or follow a different path in part to that entering the pump through the first and second inlets.

At least the second compound pump preferably comprises an additional pumping section downstream from the third pumping section. For example, the additional pumping section may be an aerodynamic pumping mechanism such as a regenerative stage. Other types of aerodynamic mechanism include side flow, side channel, and peripheral flow mechanisms.

In an alternative embodiment, the second inlet of the second pump is connected to an outlet from the first pump. In this embodiment, the second pumping section of the second pump is arranged to exhaust fluid at or around atmospheric pressure, and preferably comprises an aerodynamic pumping mechanism, for example, a regenerative stage. One or both of the first pumping section of the second pump and the second pumping section of the first pump comprises a molecular drag mechanism. The first pumping section of the first pump preferably comprises at least one turbomolecular stage. At least one of the first and second pumps preferably comprises an additional inlet upstream from the first inlet thereof. The first pump may also comprise an additional pumping section located between the additional inlet and the first inlet, and this additional pumping section may comprise at least one turbomolecular stage.

In a second aspect, the present invention provides a differentially pumped vacuum system comprising apparatus, for example a mass spectrometer, having a plurality of pressure chambers; and a pumping arrangement attached thereto for evacuating the chambers, the pumping arrangement comprising first and second compound pumps each comprising at least a first inlet, a second inlet, a first pumping section and a second pumping section downstream from the first pumping section, the sections being arranged such that fluid entering the pump from the first inlet passes through the first and second pumping sections and fluid entering the pump from the second inlet passes through, of said sections, only the second section, wherein the first inlet of the first pump is attached to an outlet from a first, relatively low, pressure chamber, the second inlet of the first pump is attached to an outlet from a second, medium pressure chamber, the first inlet of the second pump is attached to an outlet from a third, relatively high pressure chamber, and the second inlet of the second pump is connected to an outlet from the first pump, and wherein the second pumping section of the second pump is arranged to exhaust fluid at or around atmospheric pressure.

Each compound pump preferably comprises a drive shaft having mounted thereon at least one rotor element for each of the pumping sections.

This system may be a mass spectrometer system, a coating system, or other form of system comprising a plurality of differentially pumped chambers.

The present invention also provides a method of differentially evacuating a plurality of pressure chambers, the method comprising the steps of providing a pumping arrangement comprising first and second compound pumps each comprising at least a first inlet, a second inlet, a first pumping section and a second pumping section downstream from the first pumping section, the sections being arranged such that fluid entering the pump from the first inlet passes through the first and second pumping sections and fluid entering the pump from the second inlet passes through, of said sections, only the second section; and attaching the inlets of the compound pumps to the pressure chambers such that the second inlet of one of the pumps and the first inlet of the other pump are attached to an outlet or respective outlets from a common pressure chamber so that, in use, the first compound pump evacuates said one of the pressure chambers in parallel with the second compound pump.

Features described above in relation to system aspects of the invention can equally be applied to the method aspect of the invention, and vice versa.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
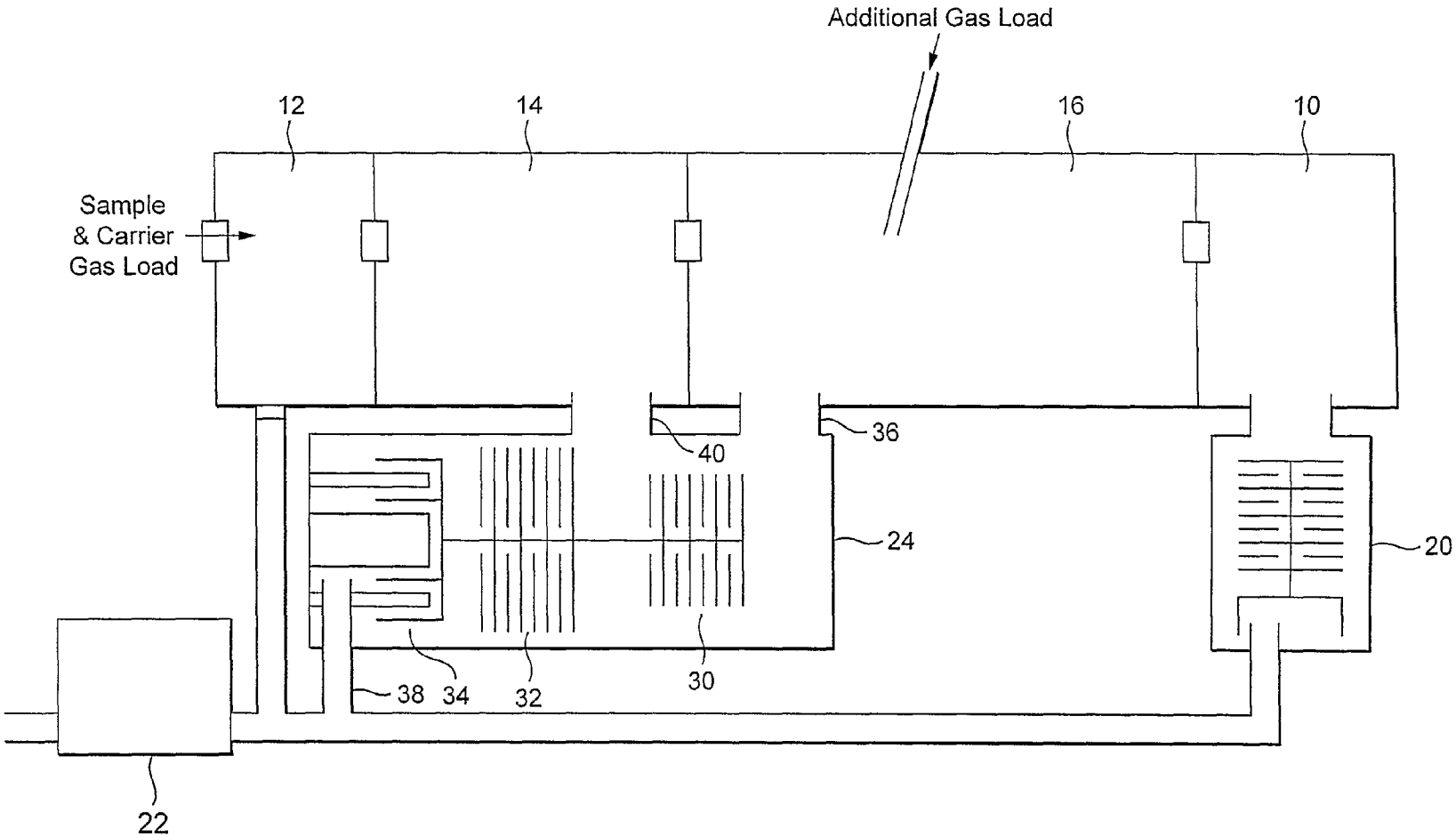
FIG. 1 (PRIOR ART)
FIG. 1 is a simplified cross-section through an example of a known pumping arrangement suitable for evacuating a differentially pumped, mass spectrometer system.
Figure 2:
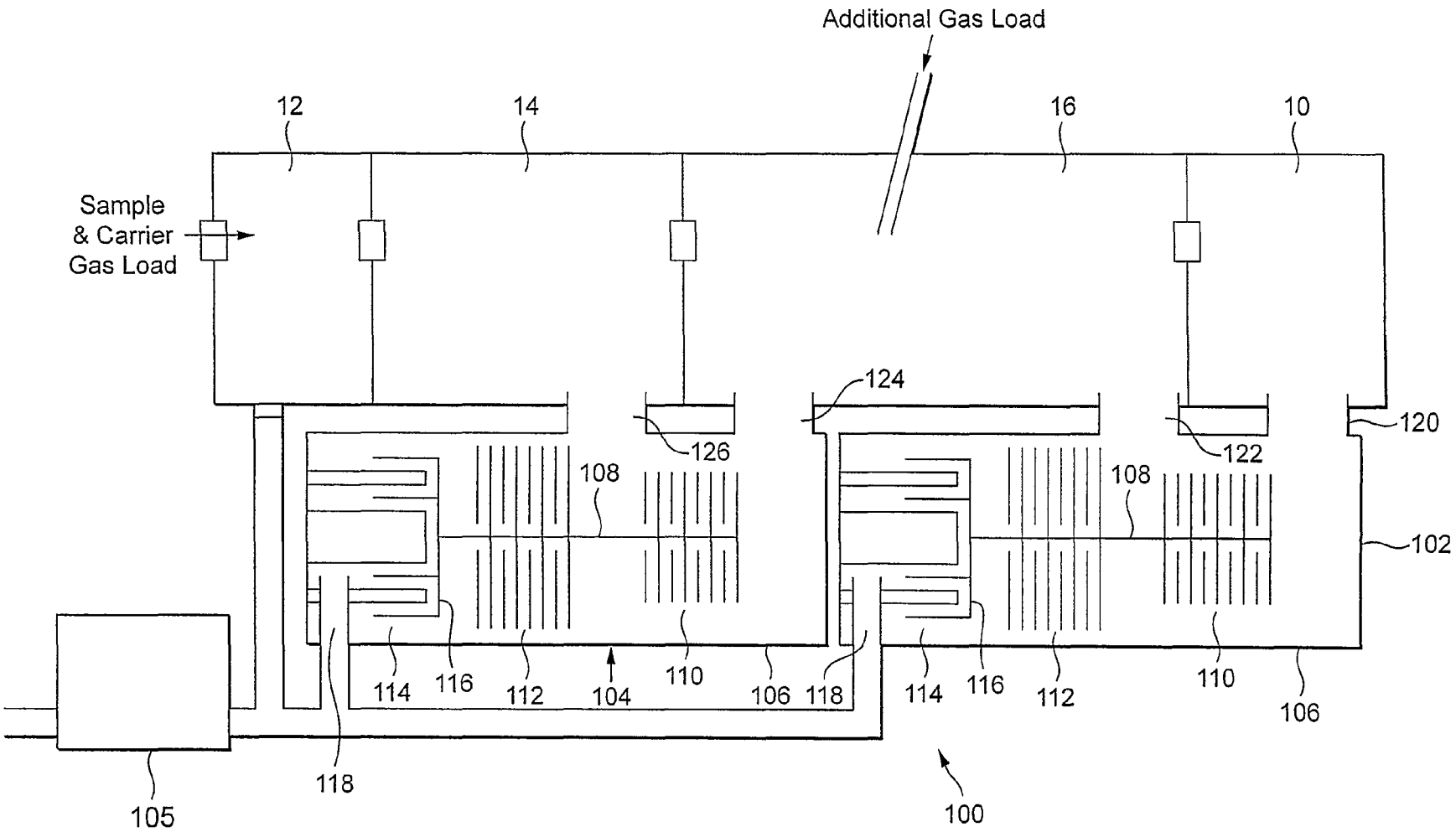
FIG. 2 is a simplified cross-section through a first embodiment of a pumping arrangement according to the invention suitable for evacuating a differentially pumped mass spectrometer system.

A first embodiment of a pumping arrangement 100 for evacuating the differentially pumped mass spectrometer system of FIG. 1 is illustrated schematically in FIG. 2. The pumping arrangement 100 comprises a first compound, multi-port pump 102, a second compound, multi-port pump 104 and a backing pump 105.

Each compound pump 102, 104 comprises a multi-component body 106 within which is mounted a drive shaft 108.

Rotation of the shaft is effected by a motor (not shown), for example, a brushless dc motor, positioned about the shaft 108. The shaft 108 is mounted on opposite bearings (not shown). For example, the drive shaft 108 may be supported by a hybrid permanent magnet bearing and oil lubricated bearing system. The orientation of the drive shaft is shown as co-axial with the longitudinal axis of the mass spectrometer system (horizontal as shown in FIG. 2), although it may be inclined at any angle, for example orthogonal or at any other orientation, with extended inlet ports as required depending upon the system performance and geometry requirements.

Each compound pump includes at least three pumping sections 110, 112, 114. The first pumping section 110 comprises a set of turbo-molecular stages. In the embodiment shown in FIG. 2, the set of turbo-molecular stages 110 comprises four rotor blades and four stator blades of known angled construction. In this example, the rotor blades are integral with the drive shaft 108.

In the embodiment shown in FIG. 2, the second pumping section 112 is similar to the first pumping section 110, and thus also comprises a set of turbo-molecular stages having four rotor blades and four stator blades of known angled construction. In this example, the rotor blades are also integral with the drive shaft 108. Alternatively, the second pumping section 112 may be provided by a different molecular pumping mechanism, such as an externally threaded, or helical, rotor.

Downstream of the first and second pumping sections is a third pumping section 114 in the form of a molecular drag mechanism, for example, a Holweck drag mechanism. In this embodiment, the Holweck mechanism comprises one or more rotating cylinder(s) and corresponding annular stators having helical channels formed therein in a manner known per se. The rotating cylinders are preferably formed from a carbon fibre material, and are mounted on a disc 116, which is located on the drive shaft 108. In this example, the disc 116 is also integral with the drive shaft 108. Downstream of the Holweck mechanism 114 is a pump outlet 118. The backing pump 105 backs the compound pumps 102, 104 via the outlets 118. Alternatively, the outlet of the first compound pump 102 may be connected to another appropriate point on the vacuum system such that the gas exiting pump 102 via port 118 passes through another part of the vacuum system prior to entering the backing pump 105.

As illustrated in FIG. 2, each compound pump 102, 104 has at least two inlets. In each compound pump 102, 104, the first, lower pressure inlet is located upstream of all of the pumping sections. The second, middle pressure inlet is located interstage the first pumping section 110 and the second pumping section 112. Although only two inlets are used in this embodiment, each compound pump may have additional inlets if required to pump additional system chambers, for example interstage the turbomolecular and Holweck pumping stages. The fluid entering the pump through any additional ports may pass through only a portion of the pumping sections or follow a different path in part to that entering the pump through the first and second inlets.

In use, each inlet is connected to a chamber of the differentially pumped mass spectrometer system. In this embodiment, the first inlet 120 of the first compound pump 102 is connected to the high vacuum, lowest pressure chamber 10, both the second inlet 122 of the first compound pump 102 and the first inlet 124 of the second compound pump 104 are connected to middle pressure, third interface chamber 16 and the second inlet 126 of the second compound pump 104 is connected to high pressure, second interface chamber 14. The highest sub-atmospheric pressure, first interface chamber 12 is evacuated by the backing pump 105. Where additional interface chambers are used, these can be connected to additional inlet ports (not shown).

Fluid passing through the first inlet 120 of the first compound pump 102 from the low pressure chamber 10 enters the pump 102, passes through the first pumping section 110, through the second pumping section 112, through all of the stages of the Holweck mechanism 114 and exits the pump 102 via pump outlet 118.

Fluid passing through the second inlet 122 of the first compound pump 102 from the third interface chamber 16 enters the pump 102, passes through the second pumping section 112, through all of the stages of the Holweck mechanism 114 and exits the pump 102 via pump outlet 118.

Fluid passing through the first inlet 124 of the second compound pump 104 from the third interface chamber 16 enters the pump 104, passes through the first pumping section 110, through the second pumping section 112, through all of the stages of the Holweck mechanism 114 and exits the pump 104 via pump outlet 118.

Fluid passing through the second inlet 126 of the second compound pump 104 from the second interface chamber 14 enters the pump 104, passes through the second pumping section 112, through all of the stages of the Holweck mechanism 114 and exits the pump 104 via pump outlet 118.

In this example, in use, and similar to the system described with reference to FIG. 1, the first interface chamber 12 is at a pressure of around 1-10 mbar, the second interface chamber 14 is at a pressure of around $10^{3}$-$10^{-2}$ mbar, the third interface chamber 16 is at a pressure of around $10^{-5}$-$10^{-4}$ mbar, and the high vacuum chamber 10 is at a pressure of around $10^{-7}$-$10^{-6}$ mbar.

In the embodiment described above, parallel pumping of one of the chambers is provided by connecting dissimilar inlets of the two compound pumps, namely the second inlet 122 of the first compound pump 102 and the first inlet 124 of the second compound pump 104, to the same chamber, in the case shown to the third interface chamber 16, although this can be selected depending upon the gas load distribution and performance requirements. This arrangement optimises the pumping performance of the pumping arrangement 100 both for the additional pumping requirements posed by the introduction of an additional gas load into the interface chamber 16 and for each of the other chambers of the differentially pumped mass spectrometer system. Providing such parallel pumping of a chamber provides a greater level of performance on the parallel pumped chamber than using a single pump inlet of the same capacity. Additionally, in contrast to an arrangement where compound pumps are operated in "true parallel", namely where similar inlets of two compound pumps are used to evacuate the same chamber, the number of inlets available for connection to other chambers can be maximised. For example, two compound pumps each with two inlets, operating in true parallel would provide differential pumping for two chambers only, whereas similar pumps using dissimilar inlets to evacuate one of the chambers would allow at least three chambers to be differentially pumped. Minimising the pumping arrangement 100 to two compound pumps 102, 104, plus backing pump 105, therefore provides a compact pumping arrangement of low cost and low component count.

As illustrated in FIG. 2, the compound pumps 102, 104 may be identical, thereby further rationalising the pumping arrangement 100, although this is not essential; the compound pumps 102, 104 are preferably chosen to provide the optimum pumping performance for a particular mass spectrometer system, taking into account the particular gas load at each stage of the mass spectrometer system.

The backing pump 105 is typically a relatively large, floor standing pump. Depending on the type of backing pump used, the performance provided by the backing pump at the first interface chamber 12 can be significantly affected by the operational frequency. For example, a direct on line backing pump running from a 50 Hz electrical supply can produce a performance in the first chamber 12 as much as a 20% lower than the performance produced by the same pump operating at 60 Hz. As the remaining chambers 10, 14, 16 are all linked to the first chamber 12, any change in the performance in the first chamber 12 would have a significant affect on the performance in the other chambers.

Figure 3:
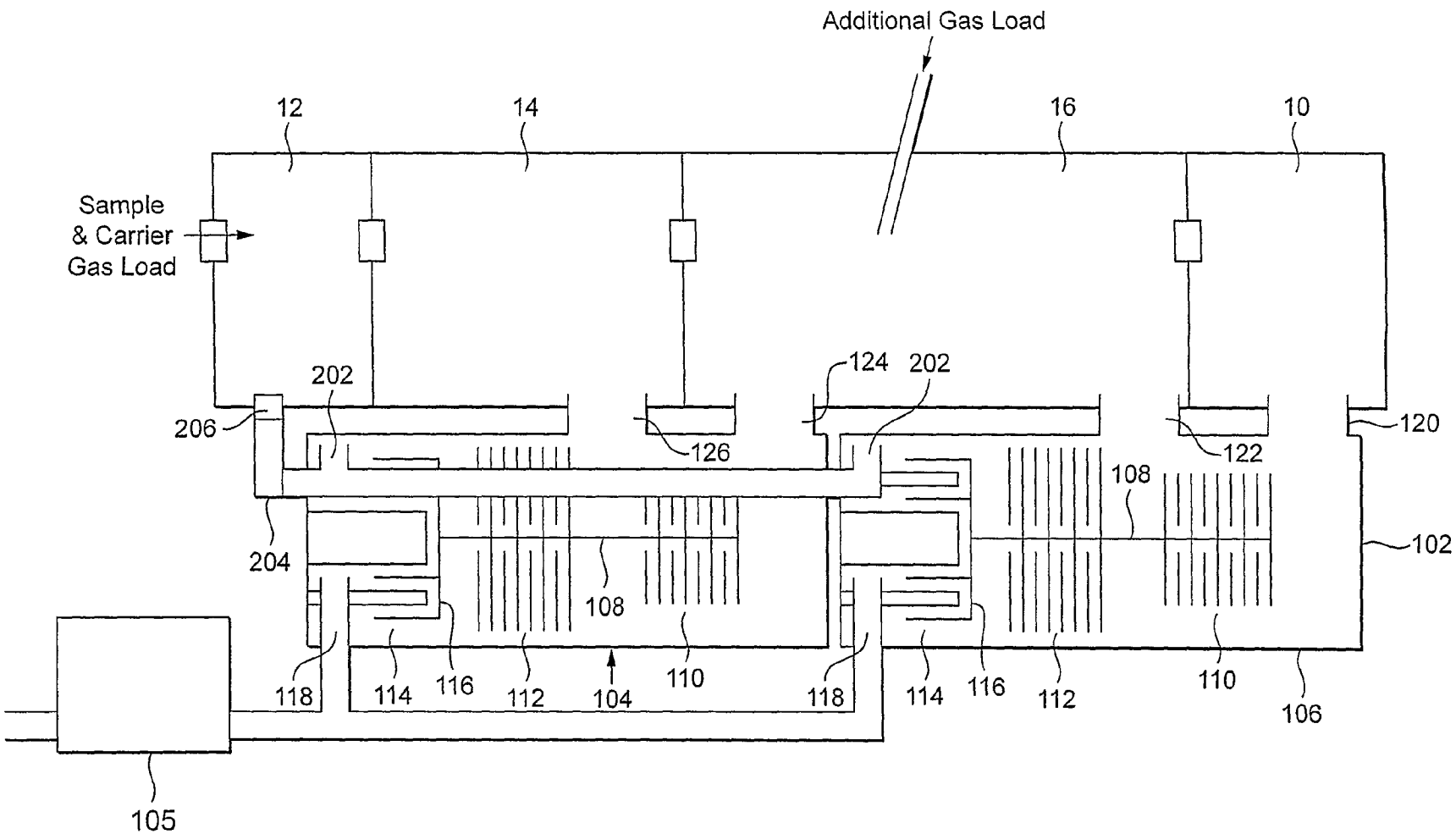
FIG. 3 is a simplified cross-section through a second embodiment of a pumping arrangement according to the invention suitable for evacuating a differentially pumped mass spectrometer system.

In order to overcome these problems, FIG. 3 illustrates a second embodiment of a pumping arrangement 200 suitable for evacuating more than 99% of the total mass flow from a differentially pumped mass spectrometer system through the compound pumps. This pumping arrangement 200 is similar to the pumping arrangement 100, save that each compound pump 102, 104 includes a third inlet 202 located downstream from the first and second inlets. A conduit 204 has an inlet 206 through which fluid from the first interface chamber 12 enters the conduit 204, the conduit 204 conveying the fluid to the third inlets 202 of each compound pump 102, 104 to provide "true parallel" pumping of the first interface chamber 12 in addition to the parallel pumping of the third interface chamber 16 as described above with reference to FIG. 2.

Each third inlet 202 may be located upstream of or, as illustrated in FIG. 3, between the stages of the Holweck mechanism 114, such that all of the stages of the Holweck mechanism are in fluid communication with the first and second inlets 120, 122, whilst, in the arrangement illustrated in FIG. 3, only a portion (one or more) of the stages are in fluid communication with the third inlet 202, so that in use fluid passing through each of the third inlets 202 from the first interface chamber 12 enters the respective compound pump, passes through at least a portion of the channels of the Holweck mechanism 114 and exits the pump via pump outlet 118.

By providing a pumping arrangement 200 in which the compound pumps are able to manage more than 99% of the total fluid mass flow of the mass spectrometer system, the aforementioned problems associated with system performance variation due to backing pump supply frequency can be reduced.

Furthermore, by providing parallel pumping of the highest pressure chamber 12, the performance of the highest pressure chamber can be increased by as much as four-fold. Increasing the performance of this chamber reduces the gas load in the subsequent chambers, thereby effectively boosting the performance in these chambers. This can compensate for the problems associated with the conductance limitations of typical compound pumping arrangements. Increasing the performance of the highest pressure chamber can also enable a higher inlet flow of ions and carrier gas into the mass spectrometer system from the ion source, thereby increasing the sensitivity of the mass spectrometer system whilst maintaining the optimum fluid pressures within the chambers. The apertures between the chambers can also be increased to accommodate the increased number of ions passing through the system whilst maintaining the optimum fluid pressures within the chambers.

Additional pumping stages can be added to the compound pumps 102, 104 to reduce the required performance of the backing pump 105. For example, a fourth pumping section (not shown), such as an aerodynamic regenerative stage, may be provided downstream of the Holweck mechanism 114. This regenerative stage may be conveniently provided by a plurality of rotors in the form of an annular array of raised rings mounted on, or integral with, the disc 116 of the Holweck mechanism 114. The stator of the Holweck mechanism 114 can also form the stator of the regenerative stage, having formed therein an annular channel within which the rotors rotate. In use, such a modified pumping arrangement can generate a similar performance advantage in the chambers of the differentially pumped mass spectrometer system as the pumping arrangements 100, 200 of the first and second embodiments. In addition to the potential performance advantage offered by these embodiments, this arrangement can also offer two further distinct advantages. The first of these is the consistency of the system performance when backed by pumps with different levels of performance, for example a backing pump operating directly on line at 50 or 60 Hz. In the case of this arrangement, it is anticipated that, in the system described with reference to FIG. 3, the variation in system performance will be as low as 1% if the frequency of operation of the backing pump 105 is varied between 50 Hz and 60 Hz, thus providing the user with a flexible pumping arrangement with stable system performance.

The second additional advantage is that by providing an additional pumping section downstream of the Holweck section, this arrangement of the compound pumps 102, 104 can enable the capacity, and thus the size, of the backing pump 105 to be significantly reduced in comparison to the first and second embodiments. This is because, by virtue of the additional pumping sections, the compound pumps can exhaust fluid at a pressure of above 10 mbar. In contrast, the compound pumps 102, 104 of the first and second embodiments typically exhausts fluid at a pressure of around 1-10 mbar, and so the size of the backing pump 105 can be reduced significantly. It is anticipated that this size reduction could be as much as a factor of 5-10 in some mass spectrometer systems without adversely affecting system performance. This can also provide for reduced total power consumption of the pumping arrangement.

With such an arrangement, that is, where an additional pumping stage is provided downstream from the Holweck mechanism 114, only one of the compound pumps 102, 104 may be required to be connected to the highest pressure chamber 12 depending on performance and power requirements. Alternatively, at least one of the inlets 202 may be located between the Holweck mechanism 114 and the additional pumping stage so that fluid entering the compound pump through that inlet does not pass through the Holweck mechanism 114.

As an alternative to reducing the size of the backing pump 105, a plurality of pumping arrangements, each for evacuating a respective mass spectrometer system, may be attached to a single backing pump, thereby reducing the overall size of the pumping arrangements for the mass spectrometer systems.

Figure 4:
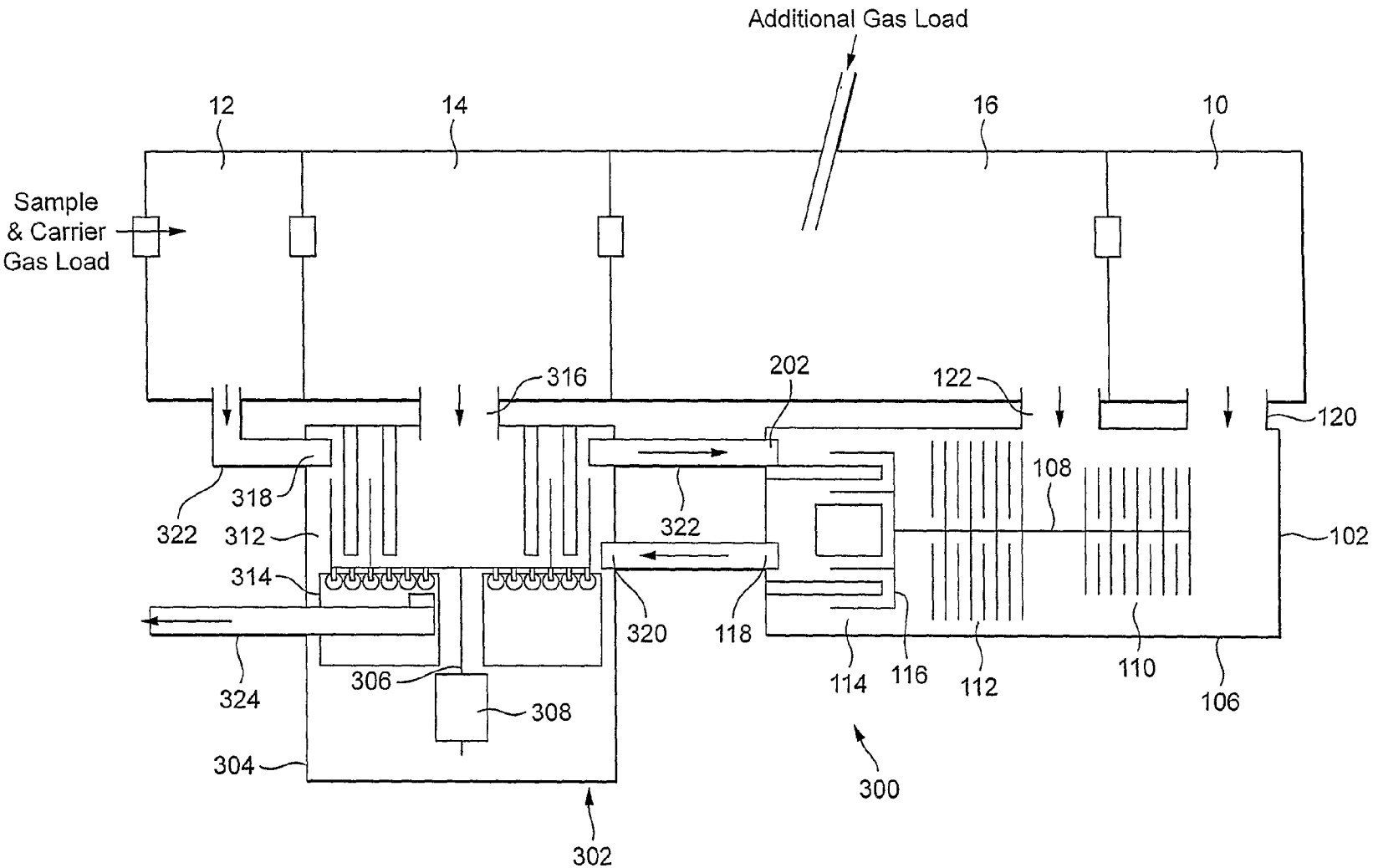
FIG. 4 is a simplified cross-section through a third embodiment of a pumping arrangement according to the invention suitable for evacuating a differentially pumped mass spectrometer system.

Similar advantages are provided by a third embodiment of a pumping arrangement 300 illustrated in FIG. 4 and which is also suitable for evacuating more than 99% of the total mass flow from a differentially pumped mass spectrometer system through a compound multi-port pump exhausting to near atmospheric pressure.

The pumping arrangement 300 comprises a first compound pump 102 similar to the compound pump 102 of the second embodiment. To recap, the compound pump 102 comprises a multi-component body 106 within which is mounted a drive shaft 108. Rotation of the shaft is effected by a motor (not shown), for example, a brushless dc motor, positioned about the shaft 108. The shaft 108 is mounted on opposite bearings (not shown). For example, the drive shaft 108 may be supported by a hybrid permanent magnet bearing and oil lubricated bearing system. The compound pump 102 includes at least three pumping sections 110, 112, 114. Each of the first pumping section 110 and the second pumping section 112 may comprise a set of turbo-molecular stages or alternatively, the second pumping section 112 may be provided by a different molecular pumping mechanism, such as an externally threaded, or helical, rotor. In the embodiment shown in FIG. 4, each set of turbo-molecular stages comprises four rotor blades and four stator blades of known angled construction. In this example, the rotor blades are integral with the drive shaft 108. The third pumping section 114 in the form of a molecular drag mechanism, for example, a Holweck drag mechanism. In this embodiment, the Holweck mechanism comprises one or more rotating cylinders and corresponding annular stators having helical channels formed therein in a manner known per se. The rotating cylinders are preferably formed from a carbon fibre material, and are mounted on a disc 116, which is located on the drive shaft 108. In this example, the disc 116 is also integral with the drive shaft 108. Downstream of the Holweck mechanism 114 is a pump outlet 118.

As illustrated in FIG. 4, the compound pump 102 has three inlets. The first, lower fluid pressure inlet 120 is located upstream of all of the pumping sections. The second, middle fluid pressure inlet 122 is located interstage the first pumping section 110 and the second pumping section 112. The third higher fluid pressure inlet 202 is located upstream of or, as illustrated in FIG. 4, between the stages of the Holweck mechanism 114, such that all of the stages of the Holweck mechanism are in fluid communication with the first and second inlets 120, 122, whilst, in the arrangement illustrated in FIG. 4, only a portion (one or more) of the stages are in fluid communication with the third inlet 202.

The pumping arrangement 300 also comprises a second compound pump 302. The second compound pump 302 comprises a body 304 within which is mounted a drive shaft 306. Rotation of the shaft 306 is effected by a motor 308 positioned about the shaft 306. The shaft 306 is mounted on opposite bearings (not shown).

The compound pump 302 includes two pumping sections 312, 314. The first pumping section 312 is in the form of a molecular drag mechanism, for example, a Holweck drag mechanism generally formed within an upper portion of the body 304. The second pumping section 314 is in the form of an aerodynamic regenerative stage provided downstream from the Holweck mechanism 312.

The second compound pump 304 also has three inlets. The first, lower fluid pressure inlet 316 is located upstream of all of the pumping sections. The second, middle fluid pressure inlet 318 between the stages of the Holweck mechanism 312, such that all of the stages of the Holweck mechanism are in fluid communication with the first inlet 316, whilst, in the arrangement illustrated in FIG. 4, only a portion (one or more) of the stages are in fluid communication with the second inlet 318. The third, higher pressure inlet 320 may be located interstage the Holweck mechanism 312 and the regenerative stage 314.

In use, the first inlet 120 of the first compound pump 102 is connected to the high vacuum, lowest pressure chamber 10, the second inlet 122 of the first compound pump 102 is connected to middle pressure interface chamber 16, the first inlet 316 of the second compound pump 302 is connected to a higher pressure interface chamber 14, and both the third inlet 202 of the first compound pump 102 and the second inlet 318 of the second compound pump 302 are connected in to the highest pressure interface chamber 12 via conduit 322 to provide parallel pumping of this interface chamber. The third inlet 320 of the second compound pump 302 is connected to the outlet 118 of the first compound pump 102.

Fluid passing through the first inlet 120 of the first compound pump 102 from the lowest pressure chamber 10 enters the pump 102, passes through the first pumping section 110, through the second pumping section 112, through all of the channels of the Holweck mechanism 114, exits the pump 102 via pump outlet 118, passes through the regenerative stage 314 of the second compound pump 302, and exits the pump 302 via outlet 324 at or near atmospheric pressure. Thus, the lowest pressure chamber 10 is evacuated by a series connection of stages of both the first and second compound pumps 102, 302.

The middle pressure interface chamber is similarly evacuated by a series connection of stages of both the first and second compound pumps 102, 302. Fluid passing through the second inlet 122 of the first compound pump 102 from the middle pressure interface chamber 16 enters the pump 102, passes through the second pumping section 112, through all of the channels of the Holweck mechanism 114, exits the pump 102 via pump outlet 118, passes through the regenerative stage 314 of the second compound pump 302 and exits the pump 302 via the outlet 324 at or near atmospheric pressure.

As mentioned earlier, the highest pressure interface chamber 12 may be evacuated in parallel by connecting thereto dissimilar inlets of the first and second compound pumps 102, 302. Fluid passing through the third inlet 202 of the first compound pump 102 from the highest pressure interface chamber 12 enters the pump 102, passes through only a portion of the Holweck mechanism 114, exits the pump 102 via pump outlet 118, passes through the regenerative stage 314 of the second compound pump 302 and exits the pump 302 via the outlet 324. Fluid passing through the second inlet 318 of the second compound pump 304 from the highest pressure interface chamber 12 enters the pump 302, passes through only a portion of the Holweck mechanism 312, passes through the regenerative stage 314 and exits the pump 302 via the outlet 324.

Fluid passing through the first inlet 316 of the second compound pump 302 from the high pressure interface chamber 16 enters the pump 302, passes through the Holweck mechanism 312 and regenerative stage 314 and exits the pump 302 via the outlet 324.

In this example, in use, the interface chamber 12 is at a pressure of around 1-10 mbar, the interface chamber 14 is at a pressure of around $10^{-3}$-$10^{-2}$ mbar, the interface chamber 16 is at a pressure of around $10^{-5}$-$10^{-4}$ mbar, and the high vacuum chamber 10 is at a pressure of around $10^{-7}$-$10^{-6}$ mbar. In this embodiment, the compound pump 302 exhausts fluid at or around atmospheric pressure. This can enable the backing pump 105 of the first and second embodiments to be eliminated altogether.

Similar to the embodiment described above with reference to FIG. 3, only one of the compound pumps 102, 302 may be required to be connected to the highest pressure chamber 12 depending on performance and power requirements.

While the foregoing description and drawings represent the preferred embodiments of the present invention, it will be apparent to those skilled in the art that various changes and modifications may be made therein without departing from the true spirit and scope of the present invention.

I claim:

1. Differentially pumped vacuum system comprising first, second and third pressure chambers; and a pumping arrangement attached thereto for evacuating the first, second, and third pressure chambers, the pumping arrangement comprising first and second compound pumps each comprising at least a first inlet, a second inlet, a first pumping section and a second pumping section downstream from the first pumping section, the sections being arranged such that fluid entering the first or second compound pump from the first inlet passes through the first and second pumping sections and fluid entering the aforementioned pump from the second inlet passes through, of said sections, only the second section, wherein the second inlet of the first compound pump and the first inlet of the second compound pump are attached to an outlet or respective outlets from the second pressure chamber in a manner that fluid in the second pressure chamber is drawn out through the second inlet of the first compound pump and the first inlet of the second compound pump, instead of through the first inlet of the first compound pump or the second inlet of the second compound pump, so that, in use, the first compound pump evacuates the second pressure chamber in parallel with the second compound pump.

2. The system according to claim 1 wherein the first inlet of the first compound pump is attached to an outlet from the first pressure chamber in a manner that fluid in the first pressure chamber is drawn out only through the first inlet of the first compound pump.

3. The system according to claim 2 wherein the second inlet of the second compound pump is attached to an outlet from the third pressure chamber in a manner that fluid in the third pressure chamber is drawn out only through the second inlet of the second compound pump.

4. The system according to claim 1 wherein at least one of the first and second pumping sections comprises at least one turbomolecular stage.

5. The system according to claim 1 wherein both of the first and second pumping sections comprise at least one turbomolecular stage.

6. The system according to claim 1 wherein the first and second pumping sections are of different size.

7. The system according to claim 1 wherein at least the second compound pump comprises a third pumping section downstream from the second pumping section, the sections being arranged such that fluid entering the second compound pump from the first inlet passes through the first, second and third pumping sections, and fluid entering the pump from the second inlet passes through, of said sections, only the second and third pumping sections.

8. The system according to claim 7 wherein the third pumping section comprises a multi-stage molecular drag mechanism.

9. The system according to claim 8 wherein the molecular drag mechanism is a multi-stage Holweck mechanism with a plurality of channels arranged as a plurality of helixes.

10. The system according to claim 7, wherein at least the second compound pump comprises a third inlet for receiving fluid from a fourth pressure chamber, the pumping sections being arranged such that fluid entering the second compound pump from the fourth chamber passes through, of said sections, only the third pumping section.

11. The system according to claim 10 wherein the third pumping section is arranged such that fluid passing therethrough from the third inlet may follow a different path than fluid passing therethrough from the second inlet.

12. The system according to claim 11 wherein the third pumping section is arranged such that fluid passing therethrough from the third inlet follows only part of the path of the fluid passing therethrough from the second inlet.

13. The system according to claim 10, wherein each compound pump has a said third inlet arranged to receive fluid from the fourth pressure chamber, the compound pumps being arranged such that the first compound pump evacuates the fourth pressure chamber in parallel with the second compound pump.

14. The system according to claim 13 wherein each said third inlet is connected to conduit means for conveying fluid thereto from an outlet of the fourth pressure chamber.

15. The system according to claim 7, wherein at least the second compound pump comprises an additional pumping section downstream from the third pumping section.

16. The system according to claim 15 wherein the additional pumping section comprises an aerodynamic pumping mechanism.

17. The system according to claim 16 wherein the aerodynamic pumping mechanism comprises a regenerative stage.

18. The system according to claim 1 wherein the first and second compound pumps are arranged such that one of the first, second, and third pressure chambers that has the highest pressure among them is evacuated in parallel.

19. The system according to claim 18 wherein the second pumping section of the first compound pump comprises a molecular drag section.

20. The system according to claim 18 wherein the first pumping section of the first compound pump comprises at least one turbomolecular stage.

* * * * *